US011641079B2

(12) United States Patent
Eskew

(10) Patent No.: US 11,641,079 B2
(45) Date of Patent: May 2, 2023

(54) MISTAKE-PROOF ELECTRICAL CONNECTORS FOR HVAC SYSTEMS

(71) Applicant: Johnson Controls Technology Company, Auburn Hills, MI (US)

(72) Inventor: Rob L. Eskew, Kingman, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 35 days.

(21) Appl. No.: 17/348,001

(22) Filed: Jun. 15, 2021

(65) Prior Publication Data

US 2022/0399685 A1 Dec. 15, 2022

(51) Int. Cl.

| | |
|---|---|
| ***H01R 13/645*** | (2006.01) |
| ***F25D 23/00*** | (2006.01) |
| ***H01R 13/621*** | (2006.01) |
| ***H01R 13/631*** | (2006.01) |

(52) U.S. Cl.

CPC ..... *H01R 13/6456* (2013.01); *F25D 23/006* (2013.01); *H01R 13/621* (2013.01); *H01R 13/631* (2013.01)

(58) Field of Classification Search

CPC ..... H01R 13/6456; H01R 13/621; H01R 13/631; F25D 23/006

See application file for complete search history.

(56) References Cited

U.S. PATENT DOCUMENTS 5,664,959 A * 9/1997 Duell ..... H01R 13/5219 439/680
6,290,528 B1 * 9/2001 Moore, Jr. ..... H01R 13/5216 439/367
6,779,989 B2 8/2004 Makino et al.
8,495,890 B2 * 7/2013 Jadric ..... H05K 7/20936 62/259.2
2002/0131869 A1 * 9/2002 Makino ..... F04C 23/008 417/53
2010/0071396 A1 * 3/2010 Jadric ..... H05K 7/20936 62/259.2
2014/0029178 A1 * 1/2014 Trudeau, Jr. ..... H02K 5/225 361/679.01
2020/0173466 A1 * 6/2020 Bhongade ..... H01R 13/622
2020/0208622 A1 7/2020 Jinnai et al.

FOREIGN PATENT DOCUMENTS

WO WO-2010111492 A2 * 9/2010 ..... F04B 39/121

* cited by examiner

*Primary Examiner* — Abdullah A Riyami
*Assistant Examiner* — Nader J Alhawamdeh
(74) *Attorney, Agent, or Firm* — Fletcher Yoder P.C.

(57) ABSTRACT

An electrical connector for a compressor of an HVAC system includes electrical leads and a plug communicatively coupled to the electrical leads. The plug includes a plug body and first connectors configured to electrically couple the electrical leads to second connectors of the compressor via engagement of the first connectors with the second connectors. The first connectors are symmetrically distributed on the plug body such that the first connectors can align with the second connectors in a plurality of alignment orientations of the first connectors and the second connectors. The plug also includes at least one interference projection radially extending from a periphery of the plug body. The at least one interference projection is configured to physically interfere with a positioning guide of the compressor and block engagement between the first connectors and the second connectors in all except for one alignment orientation of the plurality of alignment orientations.

20 Claims, 10 Drawing Sheets

MISTAKE-PROOF ELECTRICAL CONNECTORS FOR HVAC SYSTEMS

BACKGROUND

The present disclosure relates generally to heating, ventilation, and/or air conditioning (HVAC) systems, and more particularly to mistake-proof electrical connectors for compressors of HVAC systems.

Residential, light commercial, commercial, and industrial HVAC systems are used to control temperatures and air quality in residences and buildings. Generally, an HVAC system may include a compressor to circulate a refrigerant through a closed refrigeration circuit that includes an evaporator, where the refrigerant absorbs heat, and a condenser, where the refrigerant releases heat. The compressor utilizes electrical power to energize a motor that increases a pressure and/or a temperature of the refrigerant received from the evaporator and directed to the condenser. As such, the refrigerant flows within the refrigerant circuit and undergoes phase changes within normal operating temperatures and pressures of the HVAC system to enable an interior space to be conditioned to occupant specifications.

In certain embodiments, the compressor includes a shell, the motor within the shell, and a terminal assembly mounted within an opening of the shell. An interior portion of the terminal assembly may be electrically connected to the motor, while an exterior portion of the terminal assembly may include terminal posts designed to be coupled to a power source. The terminal posts may be individually coupled to specific lead wires or, alternatively, coupled to an electrical connector or wiring harness that positions multiple lead wires for simultaneous and efficient assembly. However, because the terminal posts may be symmetrically distributed relative to one another, the electrical connector may be aligned with and coupled to the terminal assembly in multiple positions. Unfortunately, only one position of the multiple positions correctly supplies the proper electrical power to the motor, without negatively affecting operation of the compressor.

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment of the present disclosure, an electrical connector for a compressor of a heating, ventilation, and/or air conditioning (HVAC) system includes a plurality of electrical leads extending from a portion of the HVAC system and a plug communicatively coupled to the plurality of electrical leads. The plug includes a plug body and a plurality of first connectors configured to electrically couple the plurality of electrical leads to a plurality of second connectors of the compressor via engagement of the plurality of first connectors with the plurality of second connectors. The plurality of first connectors is symmetrically distributed on the plug body such that the plurality of first connectors can align with the plurality of second connectors in a plurality of alignment orientations of the plurality of first connectors and the plurality of second connectors. The plug also includes at least one interference projection radially extending from a periphery of the plug body. The at least one interference projection is configured to physically interfere with a positioning guide of the compressor and block engagement between the plurality of first connectors and the plurality of second connectors in all except for one alignment orientation of the plurality of alignment orientations.

In another embodiment of the present disclosure, an electrical connector for a compressor of a heating, ventilation, and/or air conditioning (HVAC) system includes a plurality of electrical leads configured to supply power to the compressor and a plug communicatively coupled to the plurality of electrical leads. The plug includes a plug body and a connector cavity assembly formed in the plug body and configured to electrically couple the plurality of electrical leads to a terminal post assembly of the compressor. The connector cavity assembly includes at least one axis of symmetry to enable the connector cavity assembly to align with the terminal post assembly in a plurality of alignment orientations. The plug also includes at least one interference projection radially extending from a periphery of the plug body. The at least one interference projection is configured to physically interfere with a stud of the compressor in all except for one alignment orientation of the plurality of alignment orientations.

In a further embodiment of the present disclosure, a wiring harness for a compressor of a heating, ventilation, and/or air conditioning (HVAC) system includes a plurality of electrical leads configured to supply power to the compressor and a plug communicatively coupled to the plurality of electrical leads. The plug includes a plug body and a plurality of connector cavities configured to electrically couple the plurality of electrical leads to a plurality of terminal posts of the compressor. The plurality of connector cavities is symmetrically distributed on the plug body in a regular polygon shape such that the plurality of connector cavities can align with the plurality of terminal posts in a plurality alignment orientations of the plurality of connector cavities and the plurality of terminal posts. Additionally, the plug includes at least one interference projection radially extending from a periphery of the plug body. The at least one interference projection is configured to physically interfere with a positioning guide of the compressor in all except for one alignment orientation of the plurality of alignment orientations.

Other features and advantages of the present application will be apparent from the following, more detailed description of the embodiments, taken in conjunction with the accompanying drawings which illustrate, by way of example, the principles of the application.

BRIEF DESCRIPTION OF THE DRAWINGS

Various aspects of this disclosure may be better understood upon reading the following detailed description and upon reference to the drawings in which.

DETAILED DESCRIPTION

Figure 1:
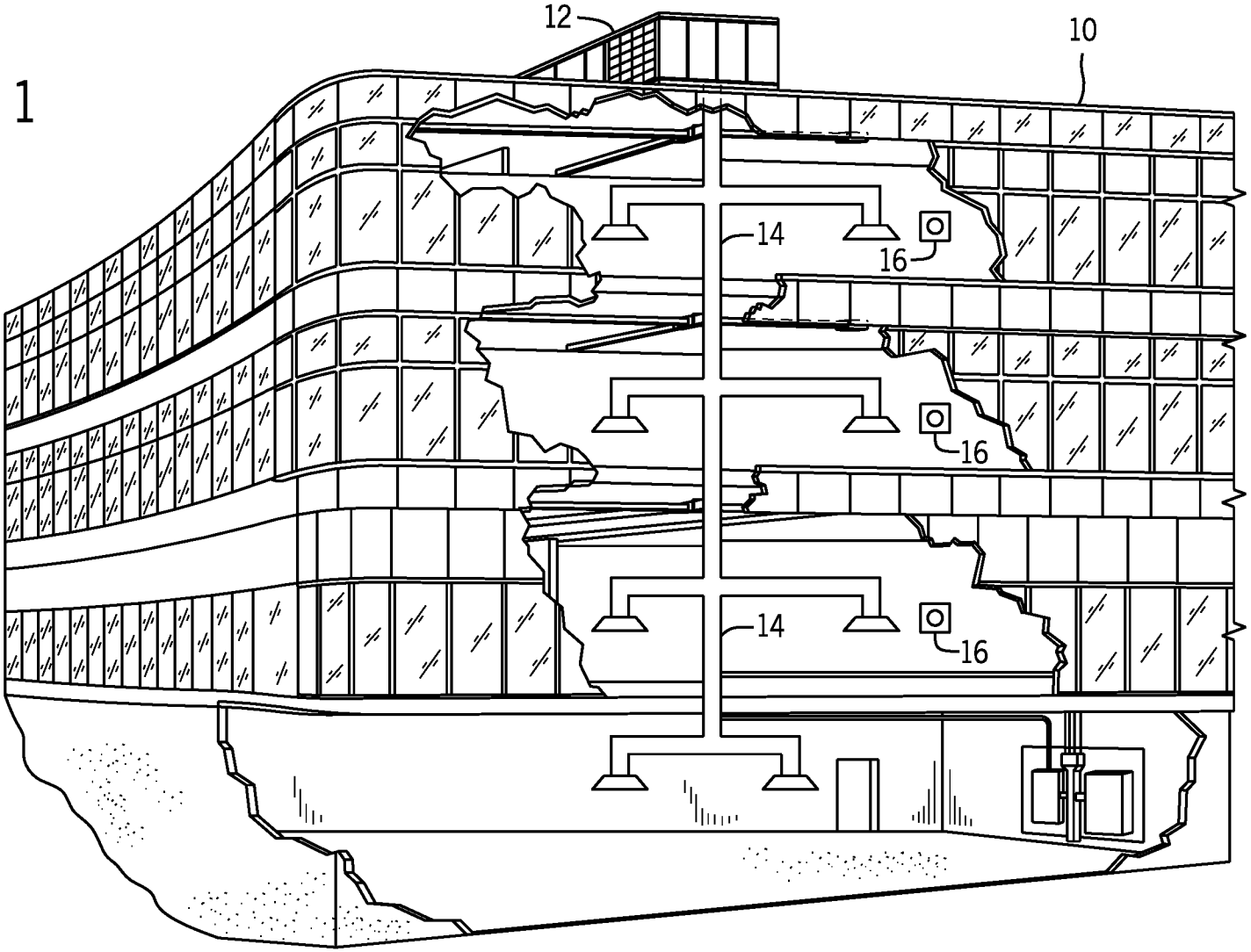
FIG. 1 is a perspective view of an embodiment of a building that may utilize a heating, ventilation, and/or air conditioning (HVAC) system in a commercial setting, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features. Further, certain terms are used herein, such as "symmetrically," such terms should be interpreted in context (e.g., within relevant tolerances and applications) and not as having rigid or mathematically perfect definitions.

As noted above, electrical connectors or wiring harnesses may be utilized to simultaneously couple multiple electrical leads to a terminal assembly of a compressor, thereby supplying power to a motor therein that facilitates operation of a heating, ventilation, and/or air conditioning (HVAC) system. For example, in certain embodiments, the terminal assembly (e.g., terminal post assembly) includes terminal posts that are symmetrically distributed relative to one another, such as within a regular polygon shape (e.g., equilateral triangle, square, pentagon) or any other suitable arrangement having at least one axis of symmetry. In such embodiments, an electrical connector (e.g., wiring harness) having a connector assembly (e.g., connector cavity assembly) with connector cavities may be aligned with and coupled to the terminal assembly in multiple alignment orientations. As such, certain compressors may include a stud, a bolt, a post, or another positioning guide around which a guiding loop or ear of the electrical connector may be disposed to facilitate assembly. However, these alignment features may still enable inadvertent user errors in assembly to occur that incorrectly supply electrical power to the motor.

Accordingly, the present disclosure is directed to various embodiments of a mistake-proof electrical connector that mitigates inadvertently incorrect installation of the connector assembly of the electrical connector relative to the terminal assembly of the compressor. For example, a plug body of the electrical connector includes the connector assembly and at least one radially extending interference projection that physically obstructs assembly of the electrical connector onto the compressor in all except for one, correct alignment orientation. Indeed, via "poka-yoke" or "mistake-proofing" techniques, the at least one interference projection of the electrical connector provides physical interference with the positioning guide of the compressor in each incorrect alignment orientation, thereby causing the only possible alignment orientation to be the correct one. As discussed in detail below, the at least one interference projection may be integrally formed with or otherwise attached to the plug body. Moreover, the at least one interference projection may include multiple, discrete extensions, or a single radial extension (e.g., skirt). In any case, the presently disclosed mistake-proof electrical connector, having the at least one interference projection, leverages the existence of the positioning guide of the compressor to provide mistake-proof power supply to the compressor.

Turning now to the drawings, FIG. 1 illustrates an embodiment of a heating, ventilation, and/or air conditioning (HVAC) system for environmental management that may employ one or more HVAC units, which include electrical connectors in accordance present embodiments. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
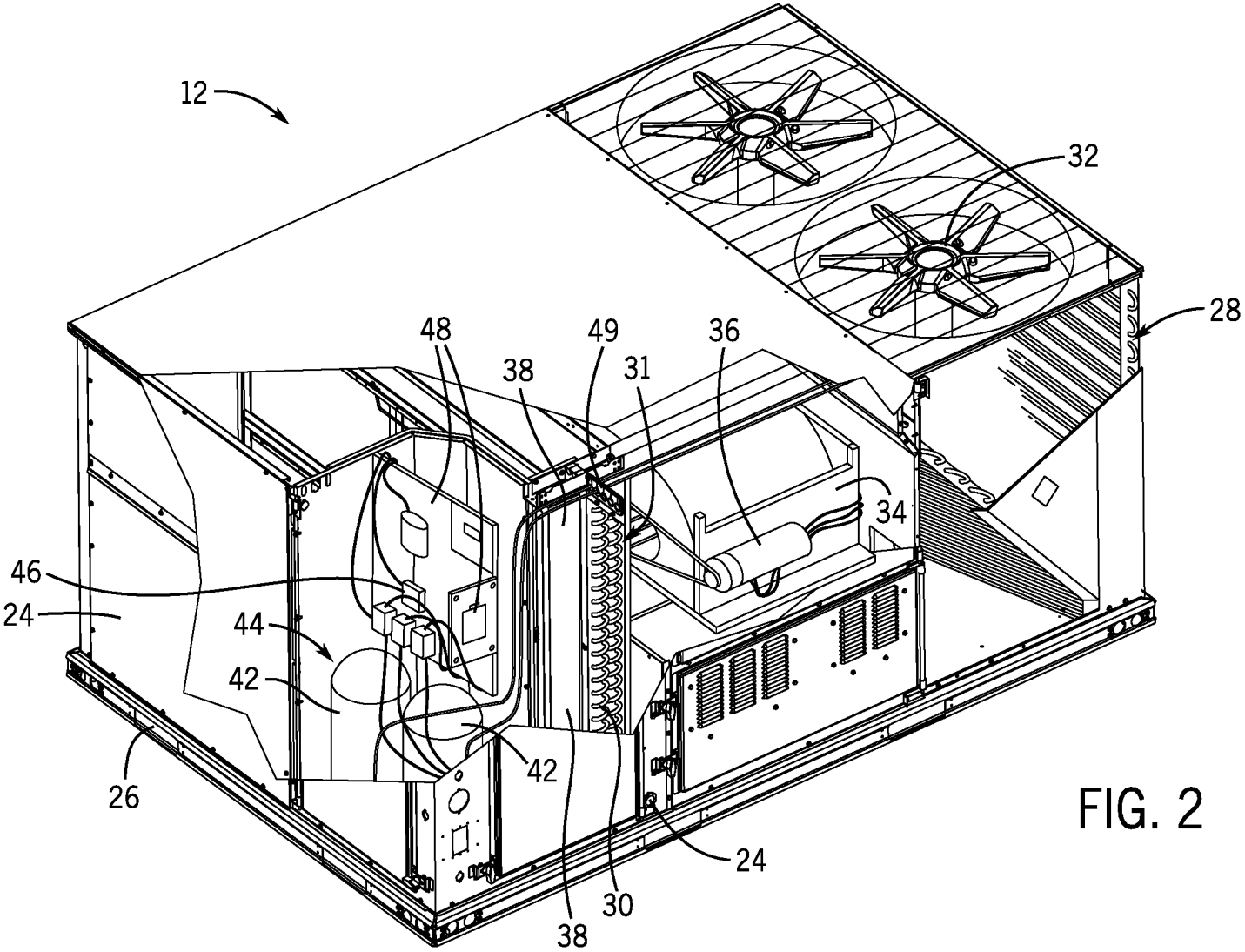
FIG. 2 is a perspective view of an embodiment of a packaged HVAC unit, which may be utilized with a residence or the building of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42, which utilize an electrical connector in accordance with present embodiments, increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
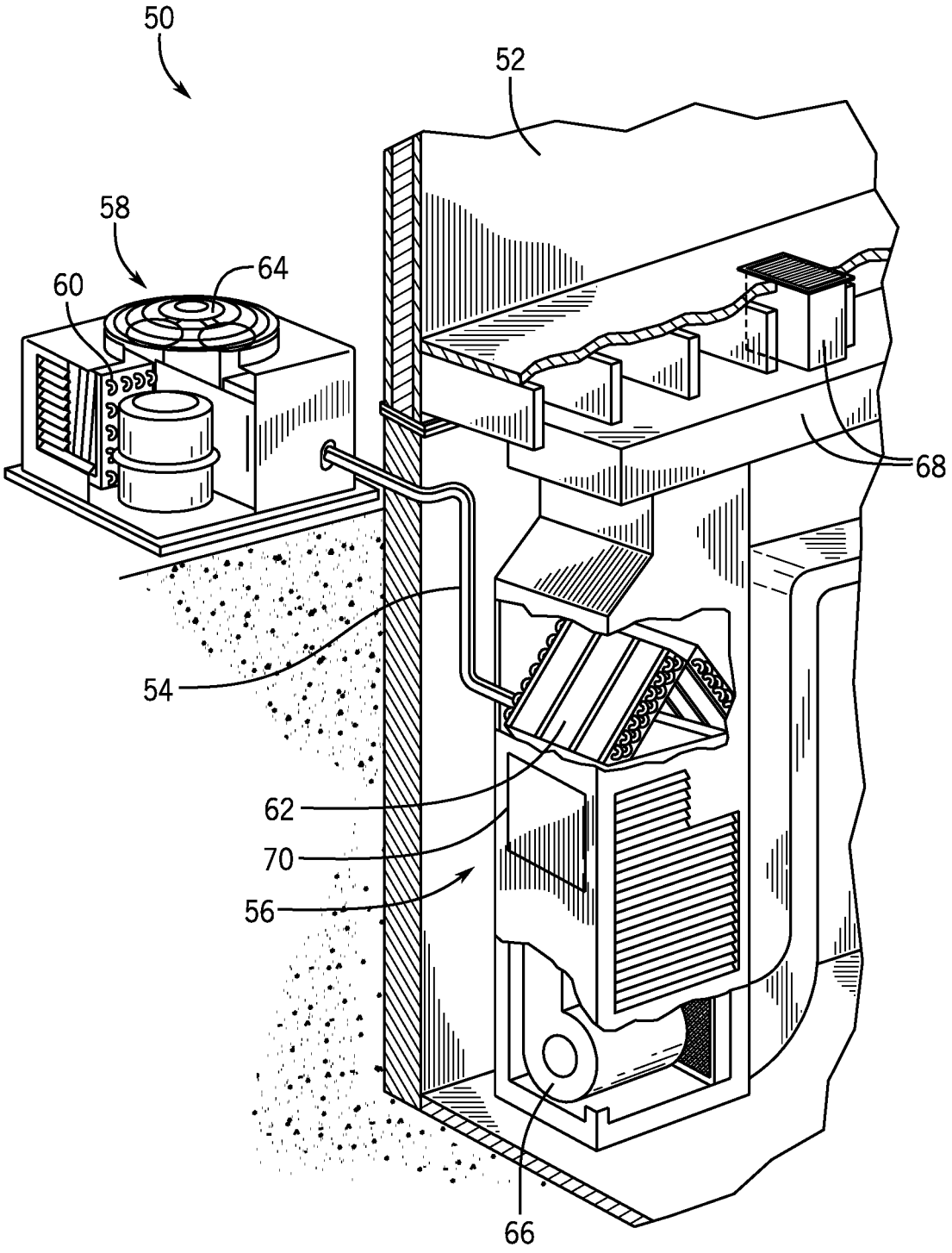
FIG. 3 is a perspective view of an embodiment of a split, residential HVAC system, in accordance with an aspect of the present disclosure.

FIG. 3 illustrates a residential heating and cooling system 50, also in accordance with present techniques. Indeed, the residential heating and cooling system 50 employs at least one electrical connector in accordance with present embodiments. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
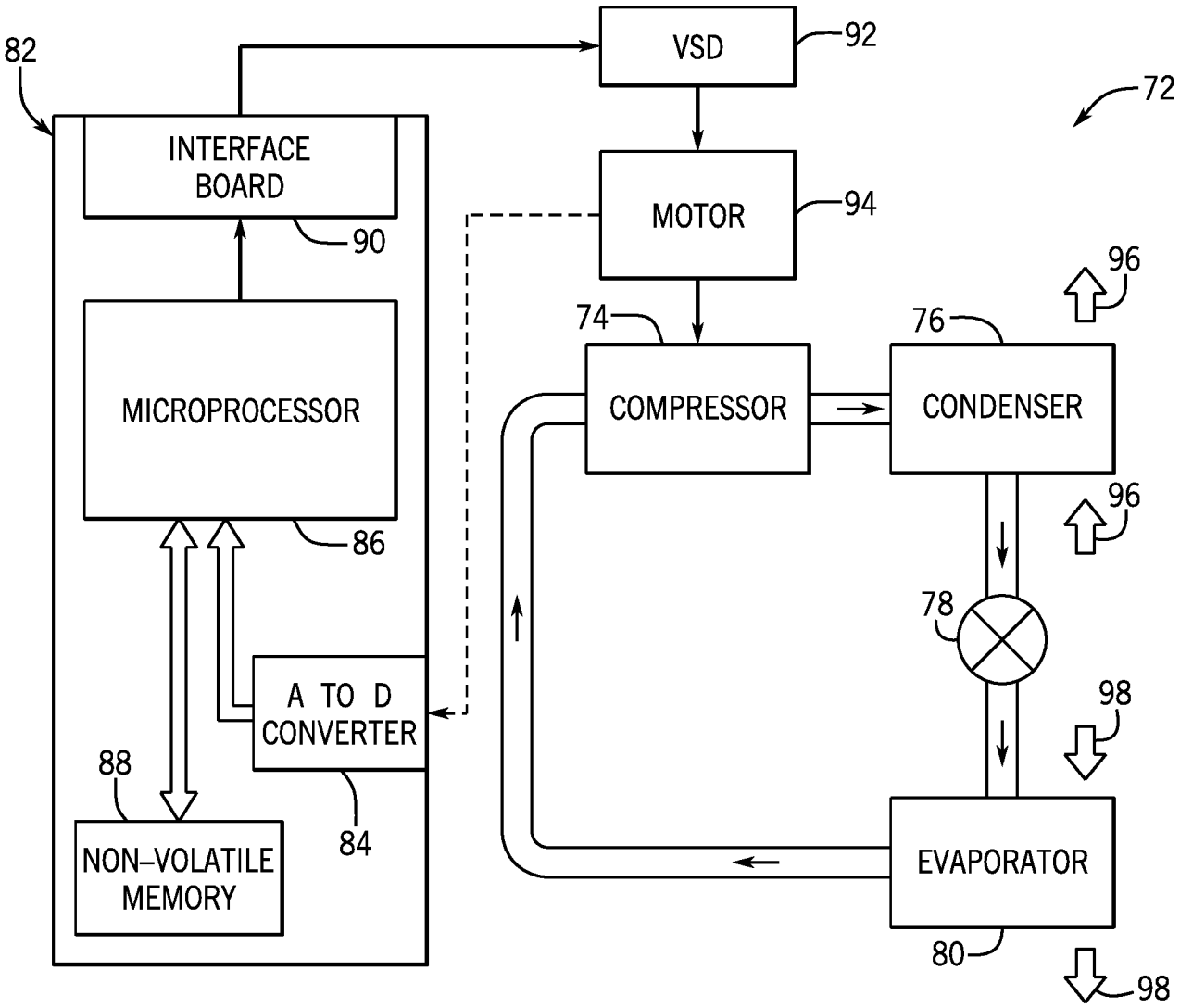
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74, which utilizes an electrical connector in accordance with present embodiments. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems typically include a compressor that drives or motivates refrigerant flow within a refrigerant circuit. A power source usually provides electrical energy to a terminal assembly extending from a shell of the compressor, such as via an electrical connector or wiring harness coupled to the terminal assembly. However, because the terminals of the terminal assembly may be symmetrically distributed relative to one another, traditional electrical connectors may be coupled to the terminal assembly in multiple orientations. Unfortunately, all but one orientation may be incorrect and cause non-operation of, reduced operating efficiency of, or damage to the compressor. In some cases, the electrical connector includes a guiding projection, ear, or loop that guides a user to install the guiding projection over or near a positioning guide (e.g., stud, bolt, post, extension, pipe stub) of the compressor. However, these guiding projections do not block installation of the electrical connector in an incorrect orientation. Indeed, the electrical connector may be installed in an orientation having the guiding position radially distant from the positioning of the compressor. Accordingly, the present embodiments of the electrical connector include one or more interference projections that physically interfere with the stud or other feature of the compressor to ensure that the assembly of the electrical connector onto the compressor is mistake proof. As will be understood, any resulting increase in manufacturing cost is thereby offset by the assurance of proper power supply to the compressor.

Figure 5:
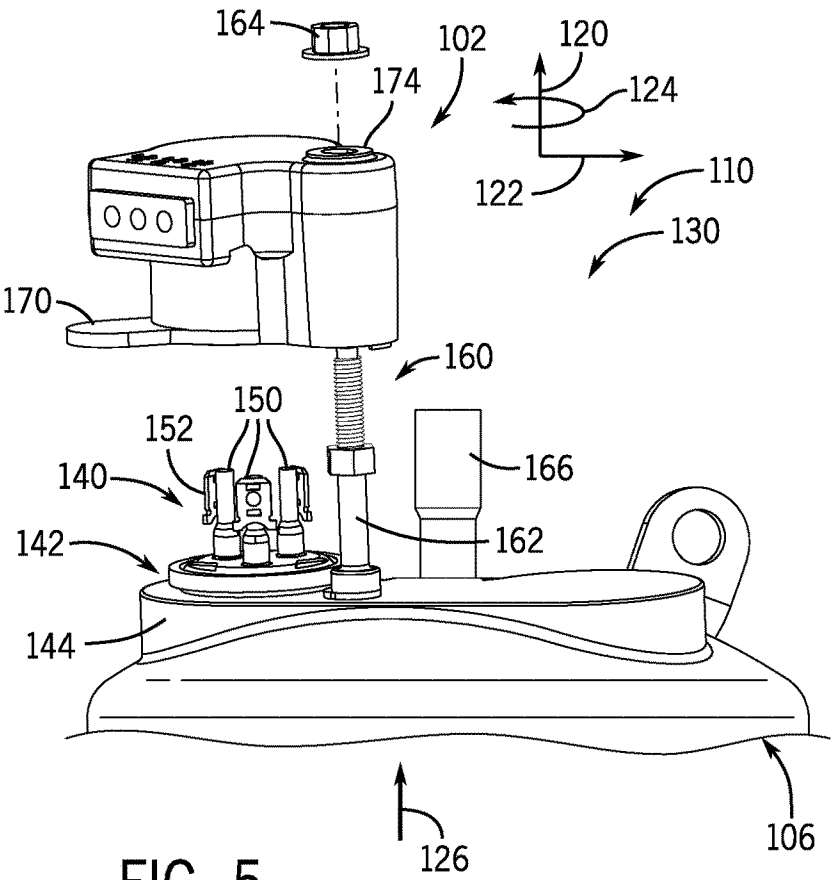
FIG. 5 is a partially exploded side view of an electrical connector for a compressor of an HVAC system aligned over terminal posts and a positioning guide of the compressor, in accordance with an aspect of the present disclosure.

With the foregoing in mind, FIG. 5 is a partially exploded side view of an electrical connector 102 (e.g., wiring harness) aligned over a compressor 106 of an HVAC system 110, such as any of the compressors of any of the HVAC systems discussed above. Indeed, it should be understood that the electrical connector 102 may be utilized on any suitable compressor or components included within the HVAC unit 12, the split, residential HVAC system 50, the vapor compression system 72, a rooftop unit (RTU), or any other suitable HVAC system. In other embodiments, the electrical connector 102 may additionally be utilized for supplying power to other components for which assembly in only one of multiple possible orientations is desired. For facilitated discussion, the electrical connector 102 will be discussed herein with reference to a longitudinal axis 120, a radial axis 122, and a circumferential axis 124 defined around the longitudinal axis 120. The longitudinal axis 120 of the electrical connector 102 is parallel to a compressor longitudinal axis 126 of the compressor 106 in the illustrated embodiment of FIG. 5, which depicts a correct alignment orientation 130 of the electrical connector 102 relative to a terminal post assembly 140 (e.g., terminal assembly) that is formed in a top portion 142 of a shell 144 (e.g., hermetic shell) of the compressor 106. Additionally, it should be understood that the terminal post assembly 140 may be positioned elsewhere on the compressor 106 and the electrical connector 102 may be suitably coupled to the terminal post assembly 140 according to the techniques disclosed herein.

In the illustrated embodiment, the electrical connector 102 is aligned over terminal posts 150 (e.g., first connectors) of the terminal post assembly 140. The terminal post assembly 140 includes three terminal posts 150 in the present embodiment. However, as discussed below with reference to later figures, it should be understood that any other suitable number of terminal posts 150 may be implemented via extension of the present techniques. The terminal posts 150 are illustrated as having flags 152 to enhance surface area for establishing electrical connections, though it should be understood that any other suitable type of terminal posts 150 may be implemented, including terminal posts without flags. Generally, the electrical connector 102 may include a number of connector cavities (e.g., second connectors) that is equal to a number of the terminal posts 150, thereby enabling a one-to-one electrical connection therebetween. It should be understood that other embodiments may alternatively include terminal posts 150 on the electrical connector 102 and include connector cavities on the compressor 106.

The compressor 106 also includes a positioning guide 160 that provides a reference point for locating the correct alignment orientation 130. In the illustrated embodiment, the positioning guide 160 is illustrated as a stud 162, having a removable fastener 164 (e.g., nut) that may retain the electrical connector 102 in position relative to the terminal post assembly 140. In other embodiments, the positioning guide 160 may additionally or alternatively include a pipe portion 166 (e.g., pipe stub) that extends from the shell 144. Indeed, the positioning guide 160 of the compressor 106 may include any suitable fastener, extension, protrusion, or component that provides a suitable, physical reference point for assembly of the electrical connector 102.

Notably, the electrical connector 102 includes at least one interference projection 170 (e.g., discrete unperforated radial extension) which, when misaligned, physically interferes with the positioning guide 160 of the compressor 106 to enhance mistake-proof installation of the electrical connector 102. In certain embodiments, the electrical connector 102 may also include a guiding projection 174 (e.g., a radial projection of the electrical connector 102 that defines an ear, loop, channel, tunnel) designed to receive the positioning guide 160. For example, the guiding projection 174 in the illustrated embodiment includes a hollow space that receives the stud 162, which may retain the properly-aligned electrical connector 102 against the compressor 106 via the removable fastener 164. The following figures and descriptions exemplify many non-limiting embodiments of the mistake-proof electrical connector 102 and the interference projections 170 thereof.

Figure 6:
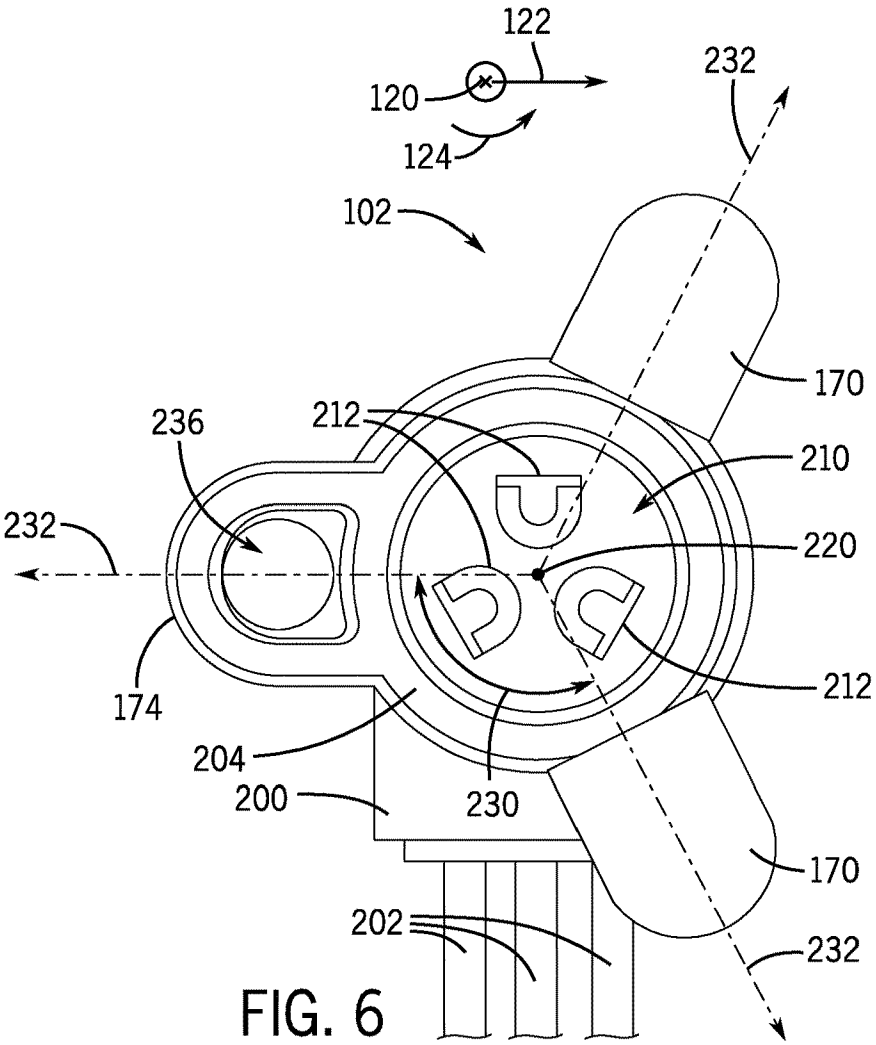
FIG. 6 is a perspective view of a compressor-facing surface of the electrical connector of FIG. 5 having electrical leads electrically coupled to connector cavities, in accordance with an aspect of the present disclosure.

FIG. 6 is a perspective view of a compressor-facing surface 200 of the electrical connector 102, which includes electrical leads 202 extending into a plug body 204. The electrical connector 102 includes a connector cavity assembly 210 with connector cavities 212 formed within the plug body 204, where each connector cavity 212 is electrically coupled to a respective electrical lead 202 (e.g., within the plug body 204). The present embodiment of the connector cavity assembly 210 includes three connector cavities 212 symmetrically distributed in a regular or equilateral triangular shape and spaced a common distance from a center point 220 of the connector cavity assembly 210. The connector cavity assembly 210 is therefore theoretically able to interface with the terminal post assembly 140 discussed above in three different alignment orientations.

However, it is important that the electrical connector 102 be coupled to the compressor 106 in the single correct alignment orientation 130 of the multiple possible alignment orientations to enable each terminal post 150 of the compressor 106 to be communicatively coupled to a particular, predetermined electrical lead 202. As such, the electrical connector 102 includes interference projections 170 extending from the plug body 204 along respective, offset radial directions discussed below. These interference projections 170 physically interface or interfere with the positioning guide 160 of the compressor 106 when user assembly is attempted in any incorrect alignment orientations. As such, the interference projections 170 selectively block incorrect engagement between the connector cavity assembly 210 and the terminal post assembly 140. The interference projections 170 may be discrete extensions or components that are integrally molded during manufacturing of the plug body 204, such as via injection molding. In other embodiments, the interference projections 170 may be coupled to the plug body 204, such as via any suitable adhesive or fasteners. Each of the interference projections 170 and the plug body 204 may be made of any suitable material, such as non-conductive plastic or rubber. Moreover, although illustrated as having rounded tips that may conserve material costs, it should be understood that the interference projections may be formed in any shape that suitably interferes with the positioning guide 160 of the compressor 106.

In the illustrated embodiment, the electrical connector 102 also includes the guiding projection 174 extending radially from the plug body 204. The guiding projection 174 is radially offset from each of the interference projections 170 in the present embodiment, such that a separation angle 230 of 120 degrees is formed between a radially-extending centerline 232 of each of the interference projections 170 and the guiding projection 174. The guiding projection 174 includes at least one through-hole 236 (e.g., opening, channel, perforation) that receives the positioning guide 160 of the compressor 106 when assembly is attempted in the correct alignment orientation 130. The guiding projection 174 may be a loop, ear, or other alignment device that visually indicates a proper installation position of the electrical connector 102. Indeed, certain traditional electrical connectors may include guiding components, and it is presently recognized that the interference projections disclosed herein may be retrofitted onto such connectors (e.g., attached after manufacturing) to provide them with mistake-proof features.

Figure 8:
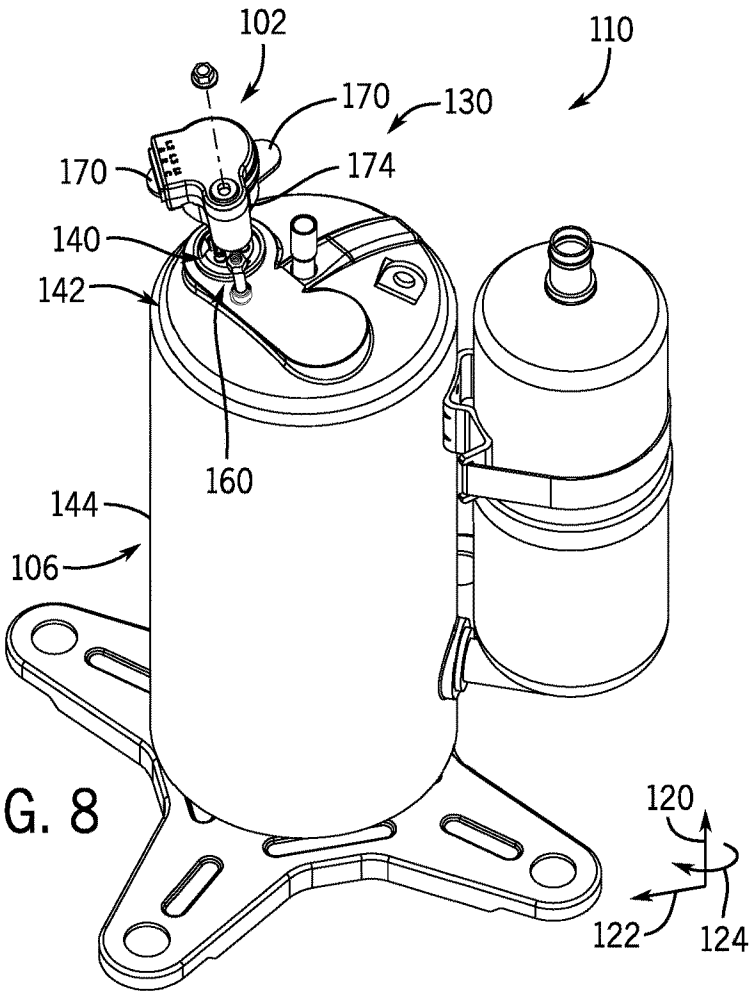
FIG. 8 is a partially exploded perspective view of the electrical connector of FIG. 7 in the correct alignment orientation relative to the compressor, in accordance with an aspect of the present disclosure.
Figure 7:
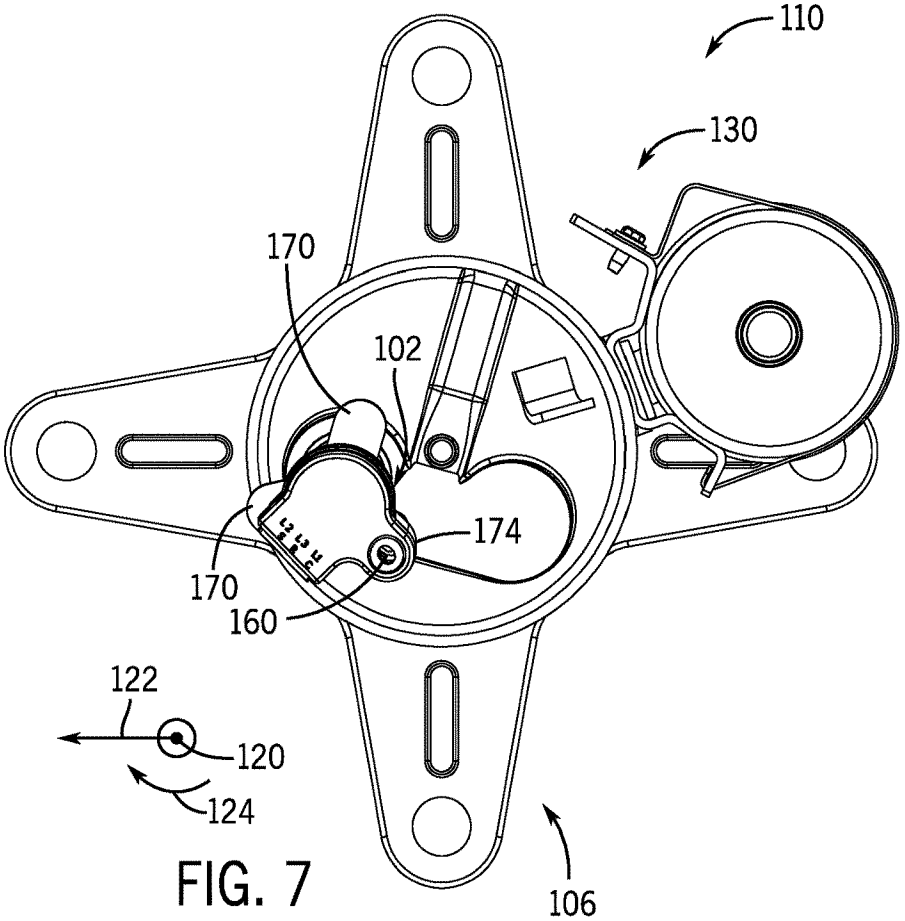
FIG. 7 is an overhead perspective view of the electrical connector of FIG. 5 in a correct alignment orientation relative to the compressor, in accordance with an aspect of the present disclosure.

FIG. 7 is an overhead perspective view of the electrical connector 102 in the correct alignment orientation 130 relative to the compressor 106. The guiding projection 174 of the electrical connector 102 is aligned over the positioning guide 160 of the compressor 106, which is a stud in the present embodiment. Indeed, due to the radial distribution of the interference projections 170 and the guiding projection 174, the interference projections 170 do not interfere with the positioning guide 160 of the compressor when the guiding projection 174 is disposed over the positioning guide 160. FIG. 8 illustrates a partially exploded perspective view of the electrical connector 102 in the correct alignment orientation 130 relative to the compressor 106, where the interference projections 170 are radially offset from the guiding projection 174 and the positioning guide 160. As will be understood with respect to other embodiments discussed below, the positioning guide 160 may be omitted in certain embodiments.

Figure 10:
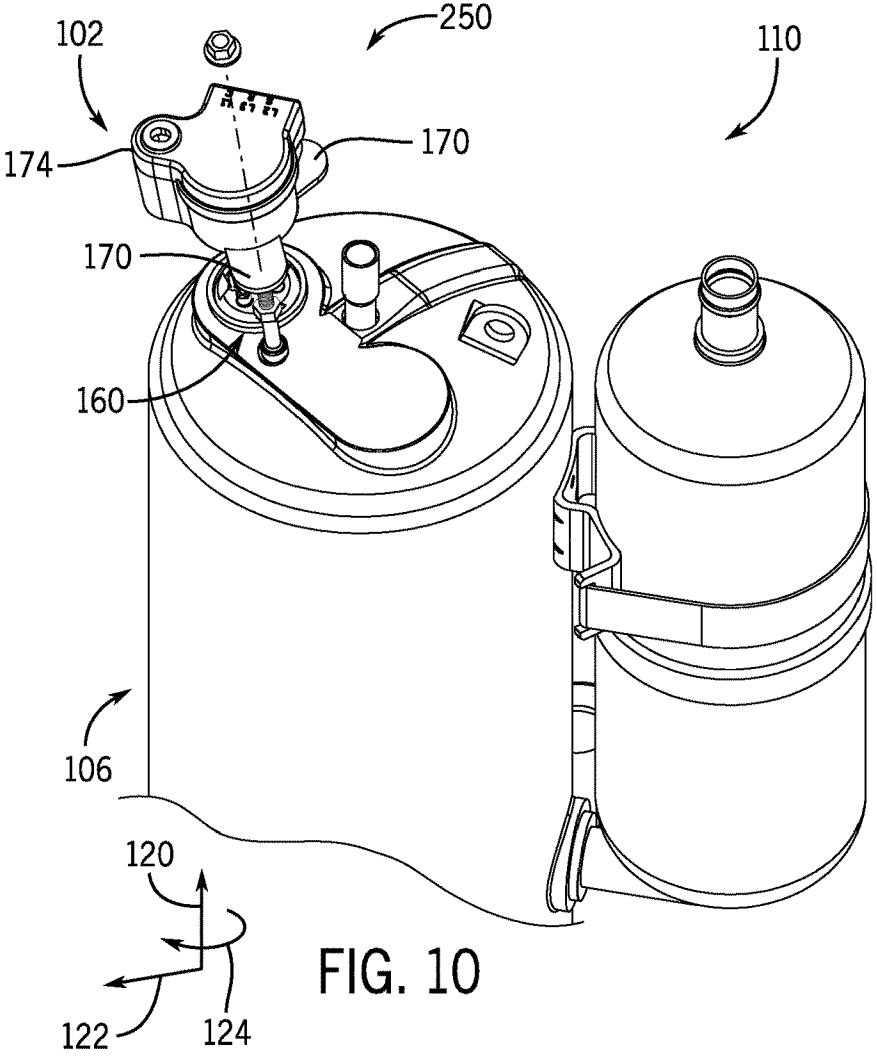
FIG. 10 is a partially exploded perspective view of the electrical connector of FIG. 7 in a second incorrect alignment orientation relative to the compressor, in accordance with an aspect of the present disclosure.
Figure 9:
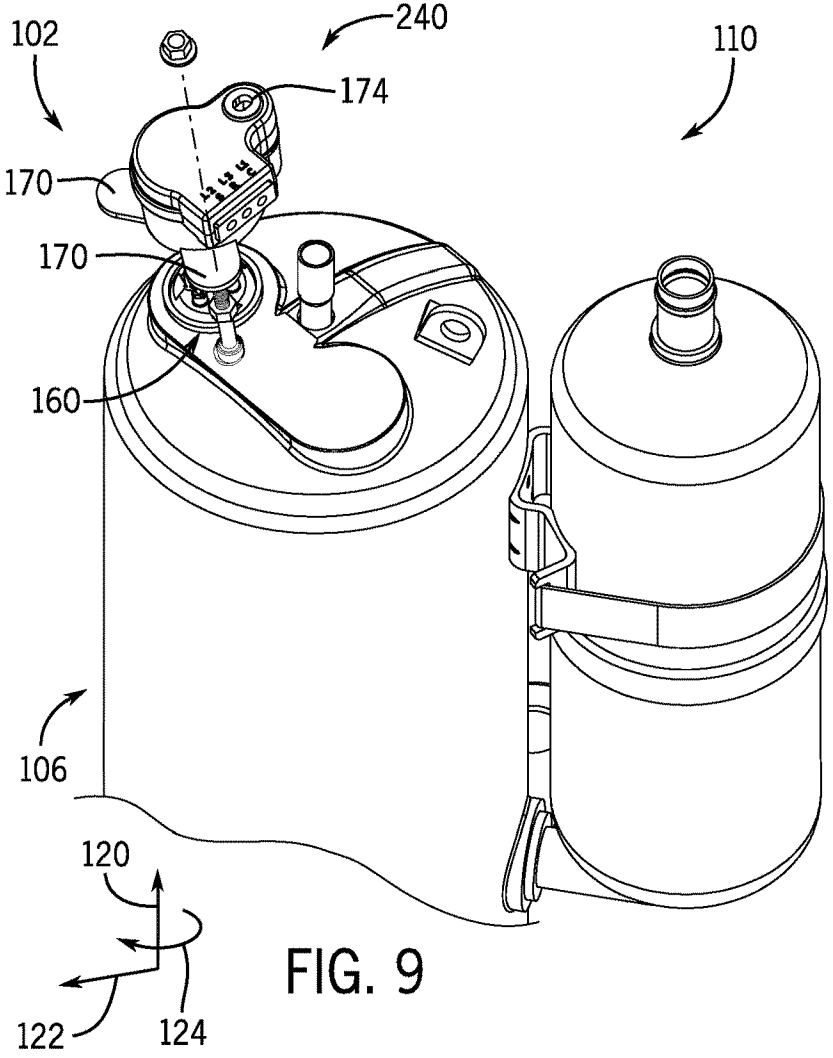
FIG. 9 is a partially exploded perspective view of the electrical connector of FIG. 7 in a first incorrect alignment orientation relative to the compressor, in accordance with an aspect of the present disclosure.

FIG. 9 is a partially exploded perspective view of the electrical connector 102 of FIG. 8, where the electrical connector 102 is rotated relative the compressor 106 by 120 degrees (e.g., along the circumferential axis 124). As such, one interference projection 170 is aligned over the positioning guide 160 of the compressor 106, preventing installation of the compressor in a first incorrect alignment orientation 240. Similarly, FIG. 10 is partially exploded perspective view of the electrical connector of FIG. 7 in a second incorrect alignment orientation 250, such as one in which the electrical connector 102 is rotated relative to the compressor 106 by an additional 120 degrees compared to the embodiment of FIG. 9. In this embodiment, the other interference projection 170 interfaces with the positioning guide 160 of the compressor 106, preventing installation of the electrical connector 102. As should be understood, the interference projections 170 therefore enable the electrical connector 102 to be coupled to the compressor 106 in a mistake-proof manner.

Figure 11:
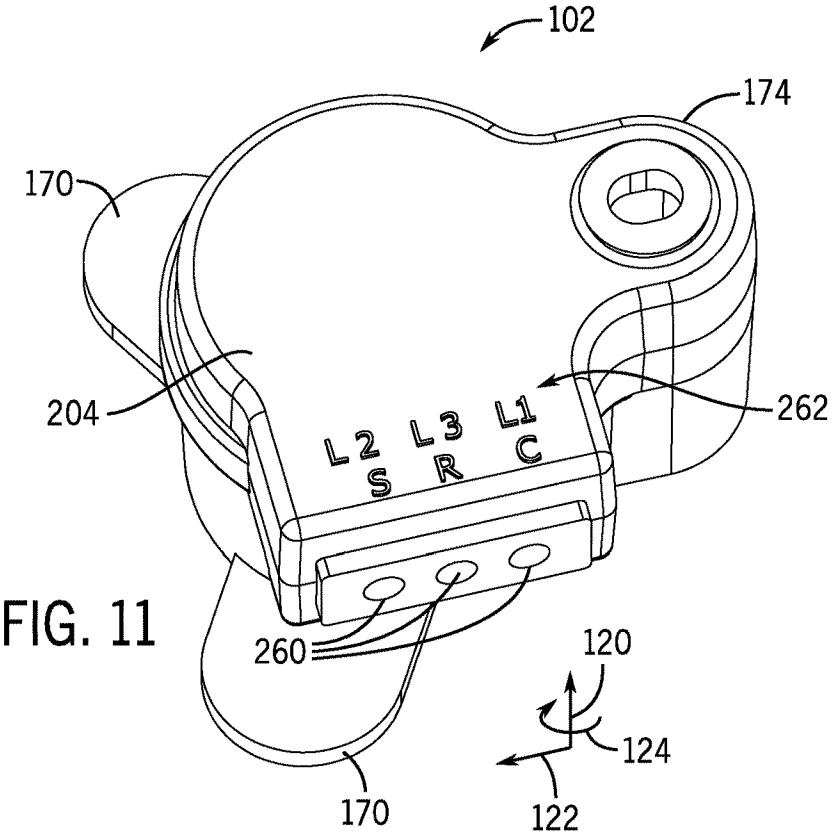
FIG. 11 is a perspective view of the electrical connector of FIG. 5 having multiple interference projections and a guiding projection, in accordance with an aspect of the present disclosure.

FIG. 11 is a perspective view of the electrical connector 102 having the two interference projections 170 and the guiding projection 174. The electrical connector 102 may also include lead receptacles 260 that receive the electrical leads 202 discussed above. In some embodiments, the plug body 204 also includes labeled indicators 262 to provide information about which electrical lead 202 is coupled (or intended to be coupled) to which lead receptacle 260.

Indeed, the lead receptacles 260 are offset along the longitudinal axis 120 relative to the interference projections 170 of the present embodiment. As such, it should be understood that the lead receptacles 260 may be positioned along the plug body 204 in any radial suitable location.

Figure 12:
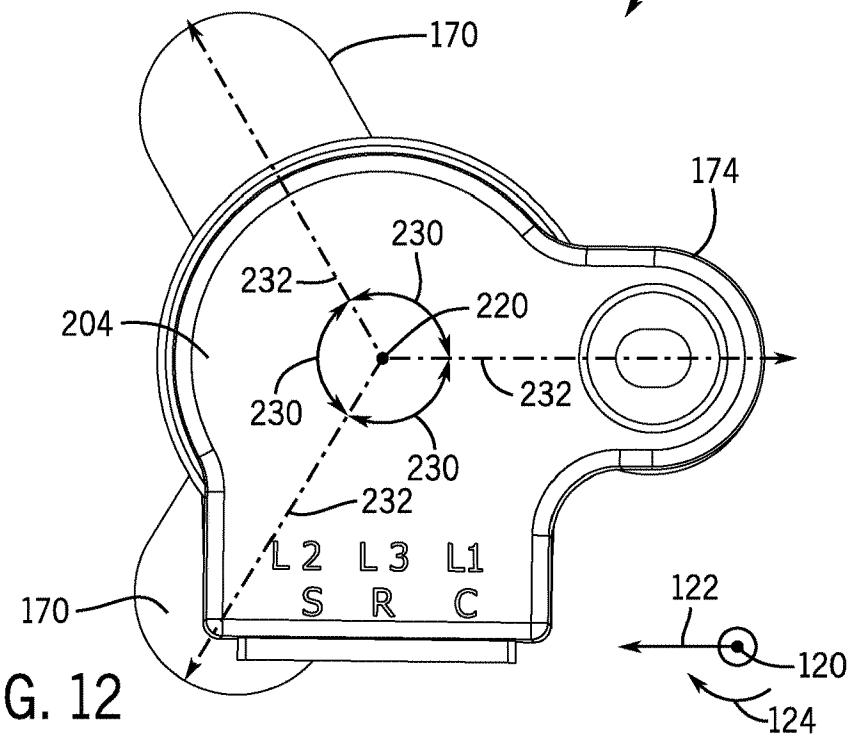
FIG. 12 is an overhead view of the electrical connector of FIG. 11, in accordance with an aspect of the present disclosure.

With additional focus on the radial offset components of the electrical connector 102, FIG. 12 shows an overhead view of the electrical connector 102 of FIG. 11. When taken together, each of the interference projections 170 and the guiding projection 174 are generally symmetrically distributed (e.g., within manufacturing and/or practical tolerances). Indeed, the respective radially-extending centerline 232 through each of the projections 170, 174 may originate at the center point 220 of the plug body 204 and proceed radially outward to be separated from its nearest neighbor by 360 degrees divided by the number of interference and guiding projections (e.g., within 3%, 4%, 5%, 6%, 7%, 8%, 9% or 10% tolerance). For the present embodiment, the separation angle 230 is 120 degrees, as discussed above. However, it should be understood that these techniques may extend to other embodiments having different numbers of connector cavities 212 and/or terminal posts 150.

Figure 13:
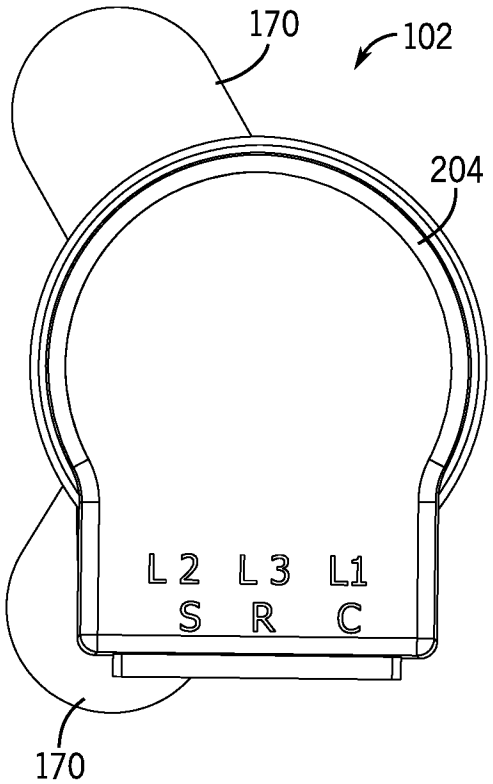
FIG. 13 is a top view of an electrical connector having multiple interference projections without a guiding projection, in accordance with an aspect of the present disclosure.

FIG. 13 is an overhead view of an electrical connector 102 having the interference projections 170 discussed above, while omitting the guiding projection 174. That is, the mistake-proofing qualities of the electrical connector 102 may be maintained without the guiding projection 174. For example, the installing technician may place the electrical connector 102 over the terminal post assembly 140 in the single correct alignment orientation 130 that is not blocked by the interference projections 170.

Figure 14:
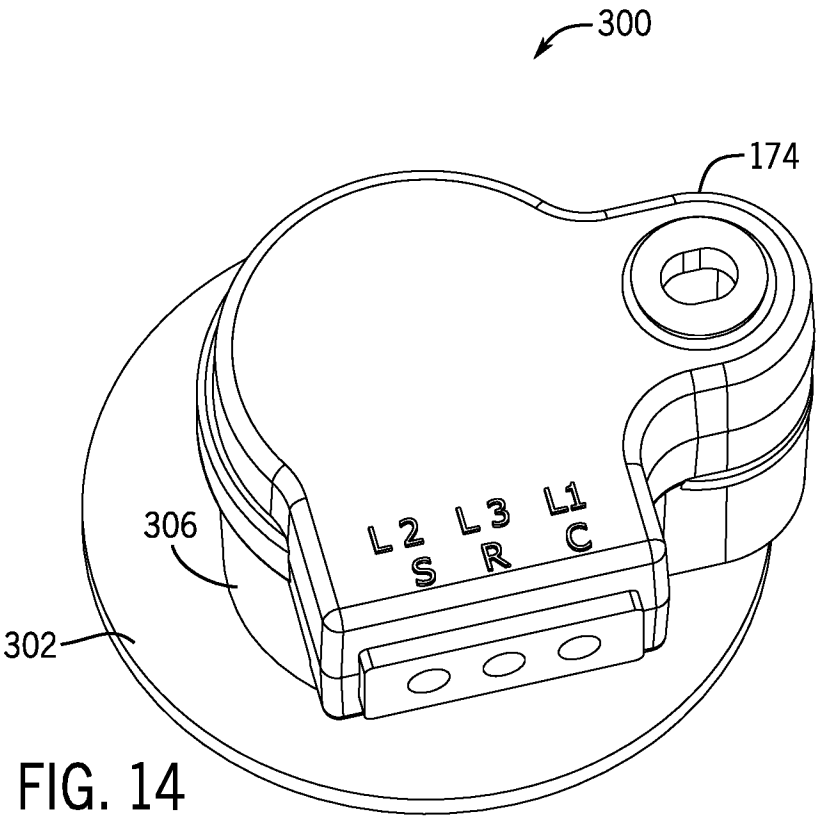
FIG. 14 is a perspective view of an electrical connector having a guiding projection and a single interference projection that extends along a majority of a periphery of a plug body of the electrical connector, in accordance with an aspect of the present disclosure.

FIG. 14 is a perspective view of an electrical connector 300 having the guiding projection 174 and a single interference projection 302 or skirt. The single interference projection 302 extends along at least half or a majority (e.g., more than 50%, 60%, 70%, 80%) of a periphery 306 of the plug body 204 of the electrical connector 102. Although there may be a slight increase in material costs, this single interference projection 302 may be easier to manufacture than embodiments with discrete interference projections, in some embodiments.

Figure 16:
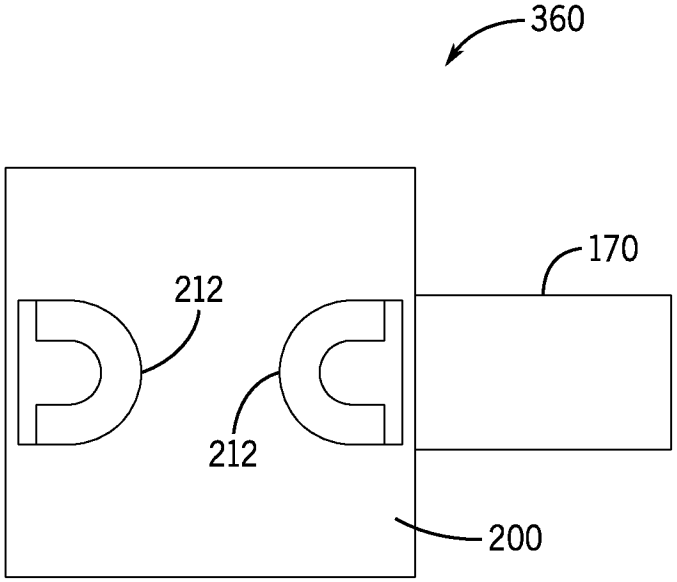
FIG. 16 is a schematic view of a compressor-facing surface of an electrical connector having one interference projection and two connector cavities, in accordance with an aspect of the present disclosure.
Figure 15:
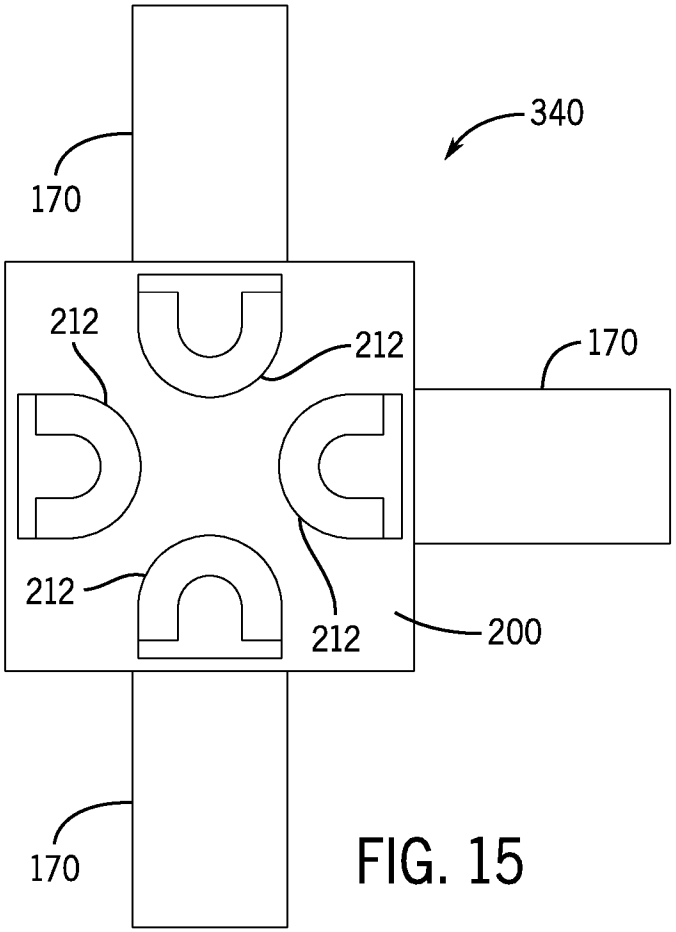
FIG. 15 is a schematic view of a compressor-facing surface of an electrical connector having three interference projections and four connector cavities, in accordance with an aspect of the present disclosure.

As mentioned, the above described qualities of the electrical connectors 102 having three connector cavities 212 may be extended to other embodiments having more or less connector cavities. Indeed, any embodiment in which the connector cavities 212 and corresponding terminal posts 150 are symmetrically distributed relative to at least one axis of symmetry, or formed in a regular polygon shape, may benefit from the mistake-proofing of the presently disclosed interference projections 170. As non-limiting examples, FIG. 15 is a schematic view of a compressor-facing surface 200 of an electrical connector 340 having three interference projections 170 and four connector cavities 212. Indeed, the connector cavities 212 are distributed in a regular square shape. Additionally, FIG. 16 is a schematic view of a compressor-facing surface 200 of an electrical connector 360 having one interference projection 170 and two connector cavities 212, which have at least one axis of symmetry relative to one another. It should be understood that the guiding projection 174 may be added to these electrical connectors 340, 360 to further facilitate assembly of the electrical connectors 340, 360 on the compressor 106. Indeed, any of the techniques discussed herein may be combined in any suitable manner that would be understood by one of skill in the art of electrical connectors.

Accordingly, the present disclosure is directed to a mistake-proof, "poka-yoke" electrical connector that enhances correct installation of an electrical connector to a compressor, such as a hermetic compressor having a symmetrically distributed terminal post assembly. A plug body of the electrical connector includes a connector assembly and at least one radially extending interference projection that physically obstructs assembly of the electrical connector onto the compressor in all except for one, correct alignment orientation. That is, at least one interference projection of the electrical connector provides physical interference with the positioning guide of the compressor in each incorrect alignment orientation. The at least one interference projection may include multiple, discrete extensions, or a single radial extension (e.g., skirt). In any case, the presently disclosed electrical connector, having the at least one interference projection, leverages the existence of the positioning guide of the compressor to provide mistake-proof power supply to the compressor.

While only certain features and embodiments of the present disclosure have been illustrated and described, many modifications and changes may occur to those skilled in the art, such as variations in sizes, dimensions, structures, shapes and proportions of the various elements, values of parameters including temperatures, pressures, and so forth, mounting arrangements, use of materials, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described, such as those unrelated to the presently contemplated best mode of carrying out the disclosure, or those unrelated to enabling the claimed features. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An electrical connector for a compressor of a heating, ventilation, and/or air conditioning (HVAC) system, comprising:

a plurality of electrical leads; and a plug comprising:

a plug body;

a plurality of first connectors electrically coupled with the plurality of electrical leads and configured to electrically engage a plurality of second connectors of the compressor, wherein the plurality of first connectors is symmetrically distributed on the plug body such that the plurality of first connectors can align with the plurality of second connectors in a plurality of alignment orientations of the plurality of first connectors and the plurality of second connectors;

at least one interference projection radially extending from a periphery of the plug body, wherein the at least one interference projection is configured to physically interfere with a positioning guide of the compressor and block engagement between the plurality of first connectors and the plurality of second connectors in all except for one alignment orientation of the plurality of alignment orientations; and a guiding projection extending radially from the plug body, and wherein the guiding projection defines a through-hole configured to receive the positioning guide of the compressor when the electrical connector is in the one alignment orientation of the plurality of alignment orientations.

2. The electrical connector of claim 1, wherein the at least one interference projection comprises a plurality of discrete unperforated radial extensions.

3. The electrical connector of claim 1, wherein the at least one interference projection comprises a single radial extension that extends along a majority of the periphery of the plug body.

4. The electrical connector of claim 1, wherein the guiding projection is radially offset from the at least one interference projection.

5. The electrical connector of claim 1, wherein the at least one interference projection is integrally formed with the plug body.

6. The electrical connector of claim 1, wherein the positioning guide comprises a stud or a bolt extending from a shell of the compressor.

7. The electrical connector of claim 1, wherein the positioning guide comprises a pipe stub extending from a shell of the compressor.

8. The electrical connector of claim 1, wherein the plurality of first connectors comprises a plurality of connector cavities, and wherein the plurality of second connectors comprises a plurality of terminal posts.

9. The electrical connector of claim 1, wherein the plurality of electrical leads is three electrical leads, the plurality of first connectors is three first connectors, the plurality of second connectors is three second connectors, and the plurality of alignment orientations is three alignment orientations.

10. The electrical connector of claim 9, wherein the three alignment orientations consist of the one alignment orientation, a first incorrect alignment orientation, and a second incorrect alignment orientation, and wherein the at least one interference projection comprises:

a first interference projection configured to physically interfere with the positioning guide in the first incorrect alignment orientation; and a second interference projection radially offset from the first interference projection and configured to physically interfere with the positioning guide in the second incorrect alignment orientation.

11. An electrical connector for a compressor of a heating, ventilation, and/or air conditioning (HVAC) system, comprising:

a plurality of electrical leads configured to supply power to the compressor; and a plug communicatively coupled to the plurality of electrical leads, wherein the plug comprises:

a plug body;

a connector cavity assembly formed in the plug body and configured to electrically couple the plurality of electrical leads to a terminal post assembly of the compressor, wherein the connector cavity assembly comprises at least one axis of symmetry that enables the connector cavity assembly to align with the terminal post assembly in a plurality of alignment orientations; and at least one interference projection radially extending from a periphery of the plug body, wherein the at least one interference projection is configured to physically interfere with a positioning guide of the compressor in all except for one alignment orientation of the plurality of alignment orientations, wherein the at least one interference projection comprises a first number of discrete interference projections that is one less than a second number of the plurality of alignment orientations.

12. The electrical connector of claim 11, wherein the connector cavity assembly comprises at least three connector cavities symmetrically distributed on the plug body in a regular polygon shape having the at least one axis of symmetry.

13. The electrical connector of claim 11, wherein the at least one interference projection comprises at least two discrete interference projections, and wherein a shape outlined between the at least two discrete interference projections and the positioning guide of the compressor is a regular polygon.

14. The electrical connector of claim 1, wherein the at least one interference projection comprises a single skirt extending radially along at least half of the periphery of the plug body.

15. A wiring harness for a compressor of a heating, ventilation, and/or air conditioning (HVAC) system, comprising:

a plurality of electrical leads configured to supply power to the compressor; and a plug communicatively coupled to the plurality of electrical leads, wherein the plug comprises:

a plug body;

a plurality of connector cavities configured to electrically couple the plurality of electrical leads to a plurality of terminal posts of the compressor, wherein the plurality of connector cavities is symmetrically distributed on the plug body in a regular polygon shape such that the plurality of connector cavities can align with the plurality of terminal posts in a plurality of alignment orientations of the plurality of connector cavities and the plurality of terminal posts, wherein a number of the plurality of alignment orientations is equal to a number of sides in the regular polygon shape formed by the plurality of connector cavities; and at least one interference projection radially extending from a periphery of the plug body, wherein the at least one interference projection is configured to physically interfere with a positioning guide of the compressor in all except for one alignment orientation of the plurality of alignment orientations.

16. The wiring harness of claim 15, wherein the plug comprises a guiding projection configured to receive the positioning guide of the compressor in the one alignment orientation of the plurality of alignment orientations, and wherein the wiring harness is configured to be retained on the compressor by a fastener disposed on the guiding projection.

17. The wiring harness of claim 15, wherein the regular polygon shape formed by the plurality of connector cavities comprises an equilateral triangle, and wherein the plurality of alignment orientations is three alignment orientations.

18. The wiring harness of claim 15, wherein the at least one interference projection is longitudinally offset from a lead receptacle of the plug, and wherein the lead receptacle is configured to receive an electrical lead of the plurality of electrical leads.

19. The electrical connector of claim 11, wherein the positioning guide comprises a stud.

20. An electrical connector for a compressor of a heating, ventilation, and/or air conditioning (HVAC) system, comprising:

a plurality of electrical leads; and a plug comprising:

a plug body;

a plurality of first connectors electrically coupled with the plurality of electrical leads and configured to electrically engage a plurality of second connectors of the compressor, wherein the plurality of first connectors is symmetrically distributed on the plug body such that the plurality of first connectors can align with the plurality of second connectors in a plurality of alignment orientations of the plurality of first connectors and the plurality of second connectors; and at least one interference projection radially extending from a periphery of the plug body, wherein the at least one interference projection is configured to physically interfere with a positioning guide of the compressor and block engagement between the plurality of first connectors and the plurality of second connectors in all except for one alignment orientation of the plurality of alignment orientations, wherein the at least one interference projection comprises a single skirt extending radially along at least half of the periphery of the plug body.

* * * * *